US009352184B2

(12) United States Patent
Davis

(10) Patent No.: US 9,352,184 B2
(45) Date of Patent: May 31, 2016

(54) EXERCISE SYSTEM AND KIT

(71) Applicant: B and A Health and Fitness, LLC, Moorestown, NJ (US)

(72) Inventor: Ross Davis, Palmyra, NJ (US)

(73) Assignee: B&A HEALTH AND FITNESS, LLC

( * ) Notice: Subject to any disclaimer, the term of this patent is extended or adjusted under 35 U.S.C. 154(b) by 0 days.

(21) Appl. No.: 14/286,085

(22) Filed: May 23, 2014

(65) Prior Publication Data

US 2014/0349821 A1 Nov. 27, 2014

Related U.S. Application Data

(60) Provisional application No. 61/826,856, filed on May 23, 2013.

(51) Int. Cl.

| | |
|---|---|
| ***A63B 21/00*** | (2006.01) |
| ***A63B 21/055*** | (2006.01) |
| ***A63B 21/02*** | (2006.01) |
| ***A63B 21/04*** | (2006.01) |
| ***A63B 21/068*** | (2006.01) |
| ***A63B 22/16*** | (2006.01) |
| ***A63B 23/02*** | (2006.01) |
| ***A63B 23/035*** | (2006.01) |

(Continued)

(52) U.S. Cl.

CPC ..... *A63B 21/0552* (2013.01); *A63B 21/0004* (2013.01); *A63B 21/00065* (2013.01); *A63B 21/028* (2013.01); *A63B 21/0414* (2013.01); *A63B 21/0555* (2013.01); *A63B 21/0557* (2013.01); *A63B 21/068* (2013.01); *A63B 21/1469* (2013.01); *A63B 21/4035* (2015.10); *A63B 21/4049* (2015.10); *A63B 22/16* (2013.01); *A63B 23/0211* (2013.01); *A63B 23/0355* (2013.01); *A63B 23/03508* (2013.01); *A63B 23/03525* (2013.01); *A63B 23/1236* (2013.01); *A63B 23/1281* (2013.01); *A63B 26/003* (2013.01); *A63B 2023/006* (2013.01); *A63B 2210/50* (2013.01)

(58) Field of Classification Search

CPC ..... A63B 21/00
USPC ..... 482/49, 126, 121
See application file for complete search history.

(56) References Cited

U.S. PATENT DOCUMENTS

| | | | |
|---|---|---|---|
| 2,920,418 | A | 1/1960 | Britt |
| 3,403,906 | A | 10/1968 | Burzenski |

(Continued)

FOREIGN PATENT DOCUMENTS

| | | |
|---|---|---|
| WO | 9405373 | 3/1994 |
| WO | 2013052192 | 4/2013 |

*Primary Examiner* — Jerome W Donnelly
(74) *Attorney, Agent, or Firm* — The Belles Group, P.C.

(57) ABSTRACT

An exercise system or kit that includes separate components that can be used together during a workout. In one embodiment, the exercise system includes a cylindrical body, an elongated bar, and one or more resistance bands. The elongated bar may be a one-piece bar or a multi-piece bar. The cylindrical body extends along a longitudinal axis and has an annular groove formed into its outer surface that surrounds the longitudinal axis and a bore extending through the cylindrical body in the direction of the longitudinal axis. The dimensions of the bar, the groove, and the bore are such that the bar can be inserted into and through the bore and the bar can be positioned within the annular groove to achieve different types of exercise. Furthermore, the resistance bands can be coupled to the elongated bar.

19 Claims, 8 Drawing Sheets

(51) Int. Cl.

| | |
|---|---|
| ***A63B 23/12*** | (2006.01) |
| ***A63B 26/00*** | (2006.01) |
| *A63B 23/00* | (2006.01) |

(56) References Cited

U.S. PATENT DOCUMENTS

| | | | | | |
|---|---|---|---|---|---|
| 3,616,794 | A | | 11/1971 | Gromala | |
| D224,935 | S | | 10/1972 | Winger | |
| 3,752,475 | A | | 8/1973 | Ott | |
| 4,712,539 | A | * | 12/1987 | Kim | 601/120 |
| 5,261,866 | A | | 11/1993 | Mattox | |
| 5,312,309 | A | * | 5/1994 | Fox | 482/45 |
| D350,796 | S | | 9/1994 | Pravitz | |
| D403,384 | S | * | 12/1998 | Clark et al. | D21/684 |
| D442,653 | S | | 5/2001 | Panes | |
| D445,852 | S | | 7/2001 | Mishan et al. | |
| D448,851 | S | | 10/2001 | Louis | |
| D451,971 | S | | 12/2001 | Mitchell | |
| D454,929 | S | | 3/2002 | Huang | |
| D456,051 | S | | 4/2002 | Mitchell | |
| D476,706 | S | | 7/2003 | Albright | |
| 7,175,573 | B1 | | 2/2007 | Huang | |
| D538,360 | S | | 3/2007 | Beaupre | |
| 7,250,032 | B2 | | 7/2007 | Fink | |
| 7,285,080 | B1 | | 10/2007 | Chiu | |
| D563,557 | S | | 3/2008 | Fink | |
| D567,951 | S | | 4/2008 | Fink | |
| D567,953 | S | | 4/2008 | Fink | |
| 7,837,603 | B1 | | 11/2010 | Carnell, Sr. | |
| D666,255 | S | | 8/2012 | Babchinetskaya et al. | |
| 8,357,109 | B2 | | 1/2013 | Destefano | |
| D679,347 | S | | 4/2013 | Frederick | |
| D679,348 | S | | 4/2013 | Frederick | |
| D688,756 | S | | 8/2013 | Wauldron et al. | |
| 2002/0187885 | A1 | | 12/2002 | Liao | |
| 2007/0184950 | A1 | | 8/2007 | Bradley | |
| 2008/0167168 | A1 | | 7/2008 | Hurst | |

* cited by examiner

EXERCISE SYSTEM AND KIT

CROSS-REFERENCE TO RELATED APPLICATIONS

This application claims priority to U.S. Provisional Patent Application Ser. No. 61/826,856, filed on May 23, 2013, the entirety of which is incorporated herein by reference.

FIELD OF THE INVENTION

The present invention relates generally to an exercise system or kit that includes several components that can be utilized together to achieve a desired workout regimen.

BACKGROUND OF THE INVENTION

There is a growing emphasis on exercise and working out in order to maintain a level of fitness that is both healthy and acceptable. With the rising levels of obesity, diabetes, heart disease, and other medical issues that arise from lack of fitness and unhealthy body weights, many people are searching for better ways to achieve a workout. While having a gym membership can be beneficial, it can also be expensive and time consuming. People have begun to find alternatives to gym membership, such as working out alongside a video in the home. However, even working out alongside a video requires that a user have weights, mats, and other equipment that can be expensive and space consuming. Furthermore, workout videos require access to a television and possibly also a DVD player or other similar device, which is not always available particularly during travel.

Thus, a need exists for an exercise system or kit that facilitates the performance of one or more exercises in the home or elsewhere, that is easily portable, and that enables a user to achieve a full body workout.

BRIEF SUMMARY OF THE INVENTION

The present invention is directed to an exercise system or kit that includes separate components that can be used together during a workout. In one embodiment, the exercise system includes a cylindrical body, an elongated bar, and one or more resistance bands. The elongated bar may be a one-piece bar or a multi-piece bar. The cylindrical body extends along a longitudinal axis and has an annular groove formed into its outer surface that surrounds the longitudinal axis and a bore extending through the cylindrical body in the direction of the longitudinal axis. The dimensions of the bar, the groove, and the bore are such that the bar can be inserted into and through the bore and the bar can be positioned within the annular groove to achieve different types of exercise. Furthermore, the resistance bands can be coupled to the elongated bar.

In one aspect, the invention can be an exercise system comprising a cylindrical body extending from a first end to a second end along a longitudinal axis, the cylindrical body having an outer surface; an annular groove formed into the outer surface of the cylindrical body, the annular groove located between the first and second ends of the cylindrical body; the cylindrical body having a first cylindrical portion extending between the first end of the cylindrical body and a first end of the annular groove and having a first length, a second cylindrical portion extending between the second end of the cylindrical body and a second end of the annular groove and having a second length, and a groove portion extending between the first and second ends of the annular groove and having a third length, the third length being less than each of the first and second lengths; a bore formed into the cylindrical body and extending from a first opening at the first end of the cylindrical body to a second opening at the second end of the cylindrical body, the bore having a first diameter; and an elongated bar extending from a first end to a second end, the elongated bar having a second diameter that is less than the first diameter, the elongated bar being removably insertable into and through the bore of the cylindrical body.

In another aspect, the invention can be an exercise kit comprising a cylindrical body extending from a first end to a second end along a longitudinal axis, the cylindrical body comprising: an annular groove formed into the outer surface of the cylindrical body, the annular groove located between the first and second ends of the cylindrical body and having a minimum radius of curvature; and a bore formed into the cylindrical body and extending from the first end of the cylindrical body to the second end of the cylindrical body, the bore having a first diameter; a bar extending along a longitudinal axis and having an outer surface with a second diameter that is less than the first diameter so that the bar can be inserted into and through the bore, the second diameter of the bar being less than two times the minimum radius of curvature of the annular groove so that the bar can be positioned within the annular groove so as to be in rolling contact with a floor of the annular groove, the bar having a first hole and a second hole formed into the outer surface of the bar on opposite sides of a longitudinal center-point of the bar; and a resistance band having a first hook coupled to a first end of the resistance band and a second hook coupled to a second end of the resistance band, and wherein the first hook is detachably couplable to the elongated bar by inserting the first hook into the first hole and wherein the second hook is detachably couplable to the elongated bar by inserting the second hook into the second hole.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
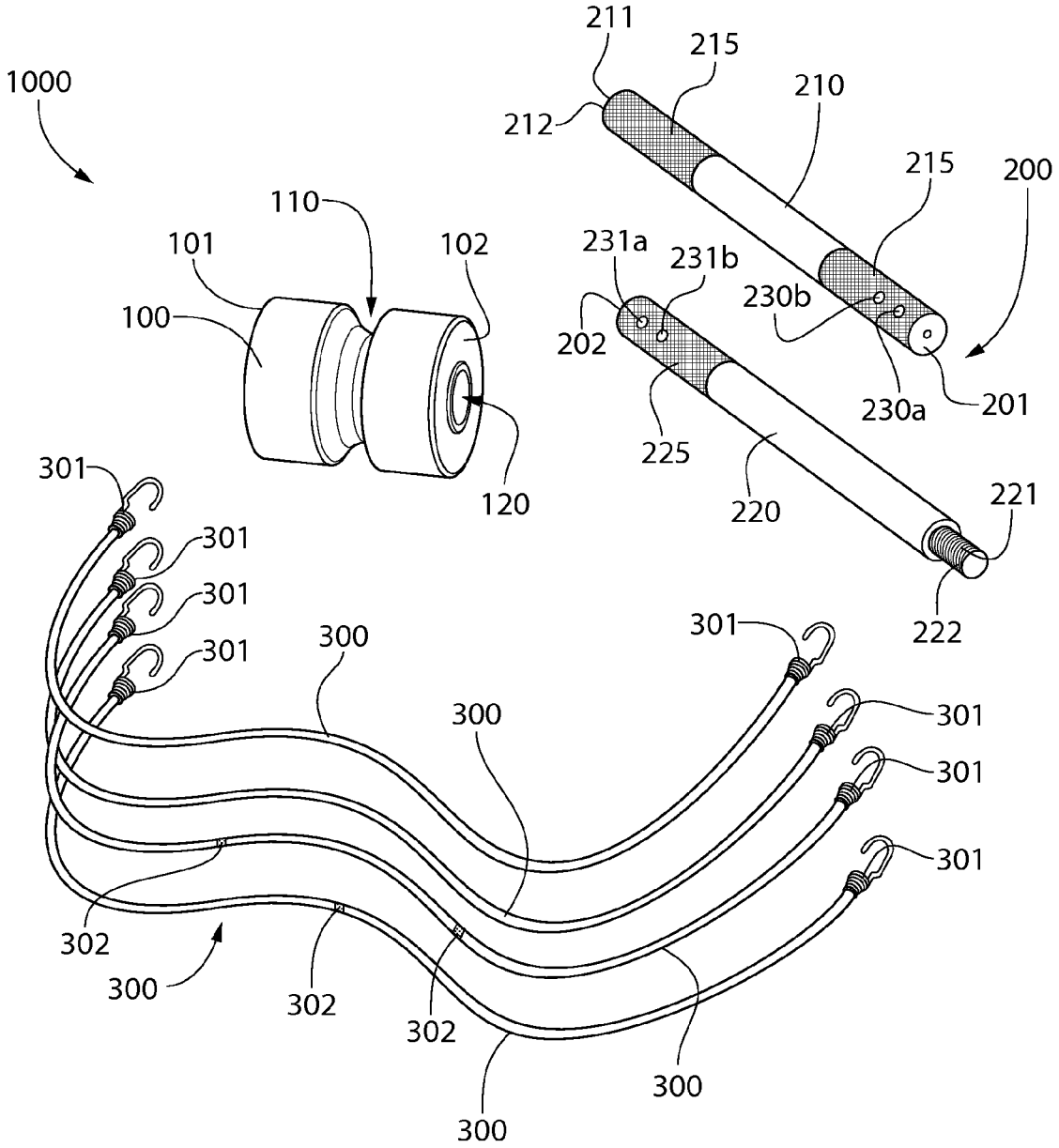
FIG. 1 is an illustration of a system including a cylindrical body, an elongated bar, and one or more resistance bands in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing wider discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an exercise system 1000 is illustrated in accordance with one embodiment of the present invention. Although described herein as being an exercise system 1000, in some embodiments the invention may be directed to an exercise kit such that the components of the system 1000 can be packaged together and sold as a kit. Furthermore, it may be possible for the components of the system 1000 to be separately packaged (or not packaged at all) and still sold as a kit. Furthermore, in some embodiments each component of the system 100 may be sold separately if desired.

The exercise system 1000 generally comprises a cylindrical body 100, an elongated bar 200, and one or more resistance bands 300. The cylindrical body 100, the elongated bar 200, and the one or more resistance bands 300 can be utilized together in order to perform different workout routines. Specifically, some workout routines may require only the cylindrical body 100 and the elongated bar 200, other workout routines may require only the elongated bar 200 and the one or more resistance bands 300, and still other workout routines may require the cylindrical body 100, the elongated bar 200, and the one or more resistance hands 300. Thus, several permutations of use of the components of the system 1000 may be used to achieve a desired workout routine. As noted above, the cylindrical body 100, the elongated, bar 200, and the one or more resistance bands 300 can be packaged together and sold as a kit, or they can be separately packaged and still sold together as a kit as desired.

Figure 2B:
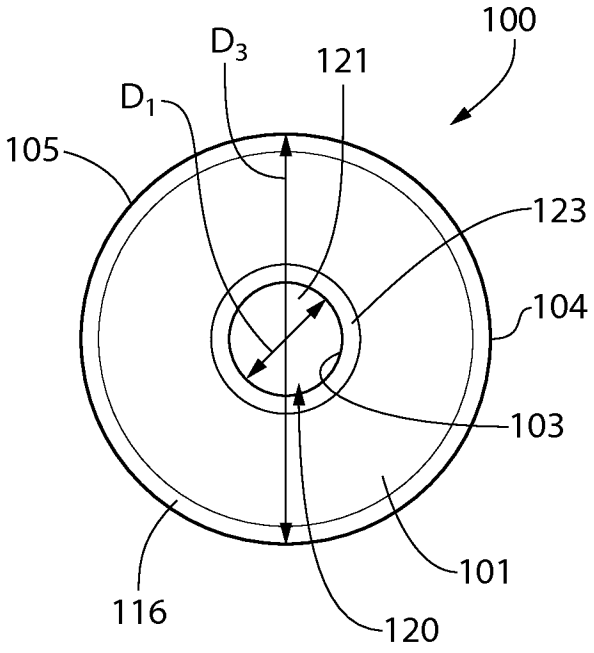
FIG. 2B is a top view of the cylindrical body of FIG. 2A.
Figure 2A:
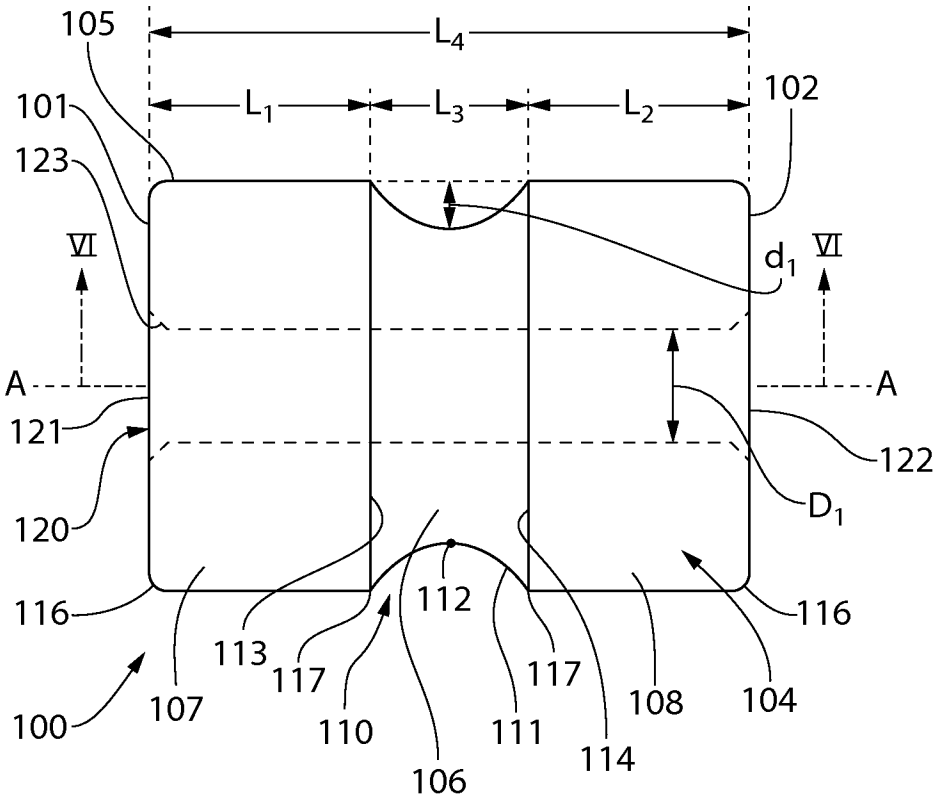
FIG. 2A is a front view of the cylindrical body of FIG. 1.

Referring to FIGS. 1, 2A, and 2B concurrently, the cylindrical body 100 of the system 1000 will be further described. The cylindrical body 100 extends from a first end 101 to a second end 102 along a longitudinal axis A-A. Conceptually, the first end 101 may be considered the top surface and the second end 102 may be considered the bottom surface or vice versa. In certain embodiments, the cylindrical body 100 has a weight in a range of 5-15 lbs., more specifically between 7-12 lbs., and still more specifically approximately 9 lbs. This light weight enables the cylindrical body 100 to be easily portable for travel. Of course, the cylindrical body 100 can have a weight that is outside of the noted ranges in other embodiments.

The cylindrical body 100 has an inner surface 103 and an outer surface 104. Furthermore, an annular groove 110 is formed into the outer surface 104 of the cylindrical body 100. The annular groove 110 extends around the entire circumference of the cylindrical body 100 and forms a reference loop about the longitudinal axis A-A such that the longitudinal axis A-A of the cylindrical body 100 intersects the center-point of the loop formed by the annular groove 110. The annular groove 110 has a first end 113 and a second end 114. Each of the first and second ends 113, 114 is an annular end portion of the annular groove 110 that defines the location on the cylindrical body 100 at which the outer surface 104 of the cylindrical body 100 begins to decrease in transverse cross-sectional area. Specifically, the first and second ends 113, 114 of the cylindrical body 100 form the transition region between the annular groove 110 of the cylindrical body 100 and the portions of the outer surface 104 of the cylindrical body 100 external to the annular groove 110.

In the exemplified embodiment, the annular groove 110 has a rounded cross-sectional profile (based on a longitudinal cross-section of the cylindrical body 100). However, the invention is not to be so limited in all embodiments and the annular groove 110 may have a square or rectangular-shaped cross-sectional profile in other embodiments. Specifically, in such an embodiment the annular groove 110 may have vertical sidewalls and a horizontal floor. In other embodiments the annular groove 110 may have a V-shaped cross-sectional profile. Thus, the invention is not to be limited by the shape of the groove 110 in all embodiments.

In the exemplified embodiment, the first and second ends 101, 102 of the cylindrical body 100 are flat, planar surfaces. Thus, the cylindrical body 100 can be positioned on a horizontal surface, such as a floor, with either of the first and second ends 101, 102 of the cylindrical body 100 in contact with the floor to maintain the cylindrical body 100 in a self-standing orientation. Alternatively, the cylindrical body 100 can be positioned on the floor with the outer surface 104 in surface contact with the floor. Due to the cylindrical shape of the cylindrical body 100, when the outer surface 104 of the cylindrical body 100 is in surface contact with the floor, the cylindrical body 100 will be able to roll along the floor, which may be desirable for specific workout routines or exercises. In certain embodiments, each of the first and second ends 101, 102 and the outer surface 104 of the cylindrical body 100 is smooth such that they have no ridges, protrusions, bumps, or the like. This will enhance the ability of the first and second ends 101, 102 of the cylindrical body 100 to maintain the cylindrical body 100 in an upright orientation and of the outer surface 104 of the cylindrical body to roll along the floor depending on the desired use of the system 1000 for a given workout routine.

The annular groove 110 conceptually divides the cylindrical body 100 into a groove portion 106, a first cylindrical portion 107, and to second cylindrical portion 108. Specifically, the first cylindrical portion 107 of the cylindrical body 100 is the portion of the cylindrical body 100 that is positioned between the first end 101 of the cylindrical body 100 and the first end 113 of the annular groove 110. The second cylindrical portion 108 of the cylindrical body 100 is the portion of the cylindrical body 100 that is positioned between the second end 102 of the cylindrical body 100 and the second end 114 of the annular groove 110. The annular groove portion 106 of the cylindrical body 100 is the portion of the cylindrical body 100 that is positioned between the first end 113 of the annular groove 110 and the second end 114 of the annular groove 110. Each of the groove portion 106, the first cylindrical portion 107, and the second cylindrical portion 108 forms a longitudinal section of the cylindrical body 100. As exemplified, each of the first and second cylindrical portions 107, 108 and the groove portion 106 of the cylindrical body 100 are formed as a single unitary structure. Thus, the first and second cylindrical portions 107, 108 of the cylindrical body 100 can not be separated from the groove portion 106 of the cylindrical body 100, but rather the cylindrical body 100 is a monolithic structure that includes each of the first and second cylindrical portions 107, 108 and the groove portion 106.

The annular groove 110 has a floor 111 that forms a portion of the outer surface 104 of the cylindrical body 100. Furthermore, the annular groove 110 has a depth $d_1$ that is measured from a lowermost point 112 of the floor 111 of the annular groove 110 to an outermost portion 105 of the outer surface 104 of the cylindrical body 100. As can be seen, the outermost portion 105 of the outer surface 104 of the cylindrical body 100 is the portion of the outer surface 104 of the cylindrical body 100 that is formed by each of the first and second cylindrical portions 107, 108 of the cylindrical body 100. In some embodiments, the depth $d_1$ of the annular groove 110 may be between 0.5 and 0.7 inches, more specifically between 0.55 and 0.65 inches, more specifically between 0.57 and 0.63 inches, and still more specifically approximately 0.6 inches. As used herein, the term approximately may include a variation, including an increase or a decrease, of up to three percent from the particular dimension or ratio provided (i.e., plus or minus three percent). This is not limited to just the dimensions provided for the depth $d_1$, but for all dimensions provided in this application. Furthermore, in certain embodiments dimensions outside of the given ranges can be used for all dimensions provided, so long as the ratios between the various dimensions are within the ranges provided herein.

In certain embodiments, the lowermost point 112 of the floor 111 of the annular groove 110 forms a center-point of the annular groove 110, the center-point of the annular groove 110 being located equidistant from the first end 113 of the annular groove 110 and the second end 114 of the annular move 110. Furthermore, in the exemplified embodiment the annular groove 110 is centrally located between the first and second ends 101, 102 of the cylindrical body 100 such that the center-point of the annular groove 110 is equidistant from each of the first and second ends 101, 102 of the cylindrical body 100.

In the exemplified embodiment the annular groove 110 is rounded and thus the annular groove 110 has radii of curvature at various points along the annular groove 110. In some embodiments, the radius of curvature of the annular groove 110 may be constant along the entirety of the annular groove 110. In other embodiments, the radius of curvature of the annular groove 110 may change depending on the exact point on the annular groove 110 at which the radius of curvature is taken. In one embodiment, the annular groove 110 has a minimum radius of curvature of between 0.8 and 0.95 inches, more specifically between 0.83 and 0.94 inches, still more specifically between 0.845 and 0.905 inches, and still more specifically approximately 0.875 inches. As will be better understood from the description below, the radius of curvature of the annular groove 110 is specifically selected to enable the elongated bar 200 to nest within the annular groove 110, possibly in rolling contact with the floor 111 of the annular groove 110, during an exercise routine.

The first cylindrical portion 107 of the cylindrical body 100 has a first length $L_1$ that is measured from the first end 101 of the cylindrical body 100 to the first end 113 of the annular groove 110. The second cylindrical portion 106 of the cylindrical body 100 has a second length $L_2$ that is measured from the second end 102 of the cylindrical body 100 to the second end 114 of the annular groove 110. The groove portion 106 of the cylindrical body 100 has a third length $L_3$ that is measured from the first end 113 of the annular groove 110 to the second end 114 of the annular groove 110. The cylindrical body 100 has a fourth length $L_4$ that is equivalent to the first length $L_1$ plus the second length $L_2$ plus the third length $L_3$.

In certain embodiments, the first length $L_1$ is substantially equal to the second length $L_2$. Furthermore, in certain embodiments each of the first and second lengths $L_1$, $L_2$ is greater than the third length $L_3$. In one particular embodiment, each of the first and second lengths $L_1$, $L_2$ is between 1.8 and 2.5 inches, more specifically between 2.0 and 2.3 inches, and still more specifically approximately 2.15 inches. Furthermore, in one particular embodiment the third length $L_3$ is between 1.4 and 2.0 inches, more specifically between 1.55 and 1.85 inches, and still more specifically approximately 1.7 inches. The fourth length $L_4$ is between 5.0 and 7.0 inches, more specifically between 5.55 and 6.35 inches, and still more specifically approximately 6.0 inches. Furthermore, in certain embodiments a ratio of either one or both of the first and second lengths $L_1$, $L_2$ to the third length $L_3$ is between 1.15:1 and 1.65:1, more specifically between 1.2:1 and 1.3:1, and still more specifically approximately 1.25:1.

In the exemplified embodiment, the corner 116 that forms the transition from the outer surface 104 of the cylindrical body 100 to each of the first and second ends 101, 102 of the cylindrical body 100 is rounded. This prevents the cylindrical body 100 from having sharp corners which have the potential to injure a user. Of course, the invention is not to be so limited in all embodiments and sharp corners can be used in other embodiments as desired for ease of manufacture or the like. In the exemplified embodiment with the rounded corner 116, the corner 116 may have a radius of curvature that is between 0.15 and 0.22 inches, more specifically between 0.17 and 0.20 inches, and still more specifically approximately 0.1875 inches. Furthermore, the corner 117 that forms the transition from the floor 111 of the annular groove 110 to the outermost portion 105 of the outer surface 104 of the cylindrical body 100 is also rounded, although it can similarly be a sharp corner if desired. In certain exemplified embodiments, the corner 117 may have a radius of curvature that is between 0.10 and 0.15 inches, more specifically between 0.11 and 0.12 inches, and still more specifically approximately 0.125 inches.

The cylindrical body 100 also comprises a bore 120 formed therethrough. The bore 120 extends in the direction of the longitudinal axis A-A such that the longitudinal axis A-A also forms the bore axis. The bore 120 extends from a first opening 121 at the first end 101 of the cylindrical body 100 to a second opening 122 at the second end 102 of the cylindrical body 100. Thus, the bore 120 forms a passageway that extends entirely through the cylindrical body 100 from the first end 101 of the cylindrical body 100 to the second end 102 of the cylindrical body 102. The inner surface 103 of the cylindrical body 100 defines and bounds the bore 120. In the exemplified embodiment, the inner surface 103 of the cylindrical body 100 has a chamfer 123 at the first and second openings 121, 122. Specifically, in the exemplified embodiment the chamfer 123 is formed at an approximately 45° angle, although angles above and below 45° could also be used, or the chamfer may be omitted in some embodiments. Chamfering the inner surface 103 of the cylindrical body 103 facilitates insertion of the elongated bar 200 into the bore 120 when it is desired to do so for a particular workout routine as will be discussed in more detail below with reference to FIG. 4.

The bore 120 has a first diameter $D_1$. The first diameter $D_1$ may be between 1.2 and 1.7 inches, more specifically between 1.35 and 1.55 inches, and still more specifically approximately 1.428 inches. Furthermore, in certain embodiments the first diameter $D_1$ may be between 1.4 inches and 1.5 inches. In some embodiments the first diameter $D_1$ of 1.428 is the low end of the first diameter $D_1$, it being understood that this diameter may be slightly larger depending on the amount of plating that is built up on the inner surface 103 of the cylindrical body 100.

The cylindrical body 100 has an outer diameter defined herein as a third diameter $D_3$, which is measured at the outermost portion 105 of the outer surface 104 of the cylindrical body 100. In the exemplified embodiment, the third diameter $D_3$ is between 4.5 and 5.5 inches, more specifically between 4.75 and 5.25 inches, still more specifically between approximately 4.98 and 5.02 inches, and even more specifically approximately 5.0 inches. In certain instances, a ratio of the third diameter $D_3$ of the cylindrical body 100 to the first diameter $D_1$ of the bore 120 is between 3.1:1 and 3.9:1, more specifically between 3.4:1 and 3.6:1, and still more specifically approximately 3.5:1. Furthermore, in certain embodiments a ratio of the third diameter $D_3$ of the cylindrical body 100 to the depth $d_1$ of the annular groove 110 is between 7.5:1 and 9.0:1, more specifically between 8.1:1 and 8.5:1, and still more specifically approximately 8.3:1. Moreover, in certain embodiments a ratio of the first diameter $D_1$ of the bore 120 to the depth $d_1$ of the annular groove 110 is between 2.25:1 and 2.5:1, more specifically between 2.3:1 and 2.4:1, and still more specifically approximately 2.35:1.

Referring to FIGS. 2A, 2B, and 6-8 concurrently, various permutations of the materials that are used to form the cylindrical body 100 (denoted in FIGS. 6-8 as the cylindrical body 100A, 100B, 100C, respectively) will be described. The letters A, B, and C will be used as a suffix after the reference numerals to distinguish between the different embodiments depicted in FIGS. 6-8, it being understood that the description of the features provided above with the same reference numeral without the suffix is applicable. The specific structural features of the cylindrical body 100 described above are applicable to each of the cylindrical bodies 100A, 100B, 100C described in FIGS. 6-8. The cylindrical bodies 100A, 100B, 100C are only used herein to describe the different types of materials that can be used to form the cylindrical body 100.

Figures 6, 7, 8:
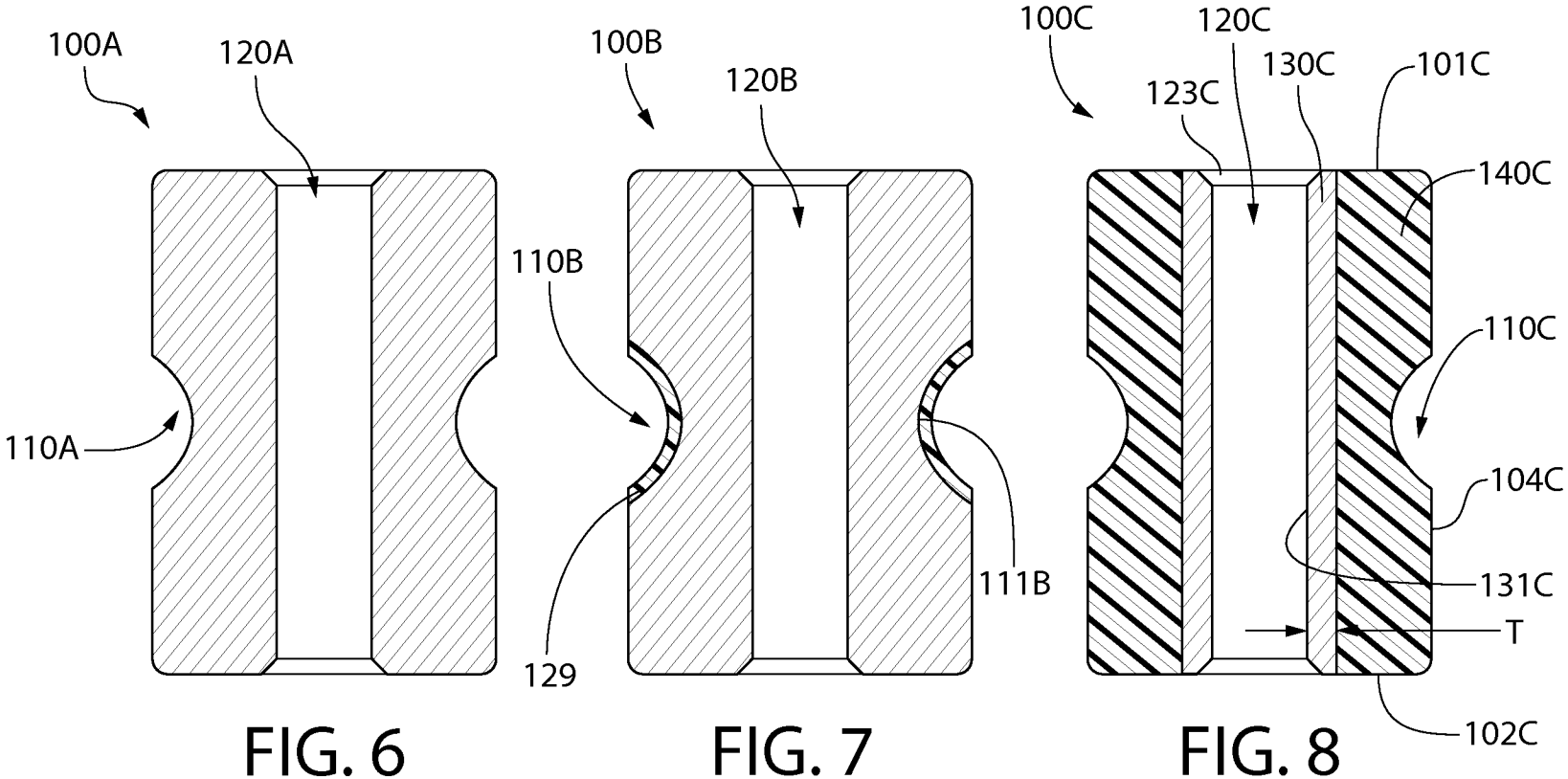
FIG. 6 is a first embodiment of a cross-sectional view taken along line VI-VI of FIG. 2A.
FIG. 7 is a second embodiment of a cross-sectional view taken along line VI-VI of FIG. 2A.
FIG. 8 is a third embodiment a cross-sectional view taken along line VI-VI of FIG. 2A.

In FIG. 6, a first embodiment of the cylindrical body 100A is illustrated. In this embodiment, the cylindrical body 100A is formed of a single material. Specifically, in this embodiment the cylindrical body 100A is formed entirely of a metal material, such as carbon steel or the like. Thus, the bore 120A and the annular groove 110A are formed directly into the solid metal material of the cylindrical body 100A.

In FIG. 7, a second embodiment of the cylindrical body 100B is illustrated. In this embodiment, the cylindrical body 100B is formed primarily of a metal material in much the same manner as the cylindrical body 100A. Thus, the annular groove 110B and the bore 120B are formed directly into the metal material of the cylindrical body 100B. However, in this embodiment the annular groove 110B is coated or otherwise covered with a rubber overmold 129B. The rubber overmold 129B may be formed of an elastomeric material, such as a rubber like styrene-butadiene, thermoplastic elastomers, or the like. Specifically, in this embodiment the rubber overmold 129B may be molded over the floor 111B of the annular groove 110B to at least partially cover the floor 111B of the annular groove 110B. Coating or otherwise covering the floor 11B of the annular groove 110B prevents metal-on-metal contact when the elongated bar 200 is positioned within the annular groove 110B during a workout routine as discussed in more detail below with reference to FIG. 3. Specifically, in this embodiment rather than having the elongated bar 200 directly contact the metal material of the cylindrical body 100, the elongated bar 200 will contact the rubber overmold 129B, which provides a resilient contact region between the elongated bar 200 and the cylindrical body 100B and avoids the loud noise that might otherwise result from the metal-on-metal contact between the elongated bar 200 and the cylindrical body 100B.

In FIG. 8, a third embodiment of the cylindrical body 100C is illustrated. The cylindrical body 100C comprises a tube portion 130C and an overmold portion 140C. In certain embodiments the tube portion 130C is formed of a first material having a first hardness value and the overmold portion 140C is formed of a second material having a second hardness value, the first hardness value being greater than the second hardness value. The tube portion 130C may be formed from a steel tube, such as one that is seamless by being formed using a drawn over mandrel (DOM) technique. In one exemplary embodiment, the tube portion 130C of the cylindrical body 100C is a round mechanical tube formed of carbon steel. The tube portion 130C has a length and an inner surface 131C, and it is the inner surface 131C of the tube portion 130C that defines the bore 120C. The tube portion 130C may have, a thickness T of approximately 0.065 inches, although other thicknesses can be used as desired. In certain embodiments, the inner surface 131C of the tube portion 130C may be coated with hard chrome having, a thickness of between 0.0005 and 0.001 inches that is smooth and free of surface imperfections. As noted above, the thickness of the hard chrome may affect the dimensions of the first diameter $D_1$ of the bore 120C.

In the exemplified embodiment, the overmold portion 140C of the cylindrical body 100C is formed of a rubber material, such as one having a Shore A durometer value of between approximately 70 and 80, and more specifically approximately 75 (similar to that which is used for outdoor roller skate or skateboard wheels). In certain exemplary embodiments, the rubber material of the overmold portion 140C of the cylindrical body 100C may be styrene-butadiene rubber (SBR). Thus, although the overmold portion 140C is formed of a rubber and is therefore somewhat resilient, due to the durometer value noted above the overmold portion 140C will still be somewhat rigid so that if the cylindrical body 100C is positioned an a horizontal surface such as a floor and is made to support a substantial amount of a users weight, the cylindrical body 100C will not just collapse or significantly indent itself. Specifically, the rubber material is somewhat of a hard rubber so that the cylindrical body 100C will still be able to substantially maintain its shape during use.

In the exemplified embodiment, the overmold portion 140C is molded to the tube portion 130C of the cylindrical body 100C along the entirety of the length of the tube portion 130C. Thus, in the exemplified embodiment no portion of the tube portion 130C protrudes beyond the overmold portion 140C at the first and second ends 101C, 102C of the cylindrical body 100C. More specifically, in the exemplified embodiment the tube portion 130C is exactly flush with the overmold portion 140C at the first and second ends 101C, 102C of the cylindrical body 100C such that it is a combination of the ends of the tube portion 130C and the ends of the overmold portion 140C that forms the first and second ends 101C, 102C of the cylindrical body. Furthermore, as exemplified in FIG. 8, no portion of the overmold portion 140C extends into the bore 120C or into the chamfer 123C.

In this embodiment, the bore 120C is formed through the tube portion 130C as discussed above. Furthermore, in this embodiment the annular groove 110C is formed into the overmold portion 140C. Thus, because the annular groove 110C is formed from a rubber material, there is no metal-on-metal contact when the elongated bar 200 is positioned within the annular groove 110C as discussed above. Furthermore, in this embodiment the entirety of the outer surface 104C of the cylindrical body 100C is formed of a rubber material. This can be beneficial for use of the device on a hardwood floor. Specifically, during use the cylindrical body 100C is in rolling contact with a floor, which can be a carpet, a hardwood floor, tiles, vinyl or the like. When in rolling contact with a floor, the outer surface 104C of the cylindrical body 100C is in direct surface contact with the floor. Thus, thrilling the outer surface 104C of the cylindrical body 100C out of a rubber material will reduce the likelihood of causing damage to the floor surface upon which the cylindrical body 100C is positioned during use.

Referring now to FIGS. 1 and 9-11 concurrently, various embodiments of the elongated bar 200 will be described. First, referring to FIGS. 1 and 11, the elongated bar 200 is exemplified as a two-piece bar. Specifically, in this embodiment the elongated bar 200 comprises a first member 210 extending from a first end 201 of the elongated bar 200 to a second end 211 and a second member 220 extending from a first end 221 to a second end 202 of the elongated bar 200. In this embodiment, the second end 211 of the first member 210 comprises a first connector 212 and the first end 221 of the second member 220 comprises a second connector 222. In this embodiment, the first and second members 210, 220 of the elongated bar 200 are detachably coupled together by connecting the first connector 212 of the first member 210 to the second connector 222 of the second member 220.

In the exemplified embodiment, the first connector 212 comprises female threads and the second connector 222 comprises male threads such that the first and second members 210, 220 are threadably couplable to one another. In other embodiments, the first connector 212 may comprise the male threads and the second connector 222 may comprise the female threads. Furthermore, in still other embodiments connection features other than threads may be used, such as fasteners, snap-fit, interference fit, keyed arrangement, protrusion/indent, or the like.

Furthermore, in the exemplified embodiment the elongated bar 200 comprises first holes 230*a*, 230*b* formed into the elongated bar 200 adjacent the first end 201 of the elongated bar 200 and second holes 231*a*, 231*b* formed into the elongated bar 200 adjacent the second end 202 of the elongated bar 200. In one embodiment the holes 230*a*, 230*b*, 231*a*, 231*b* have a diameter of approximately 0.25 inches, although other diameters can be used as desired. The elongated bar 200 extends along a longitudinal axis C-C, and at least one of the holes 230*a*, 230*b* is formed into the outer surface of the elongated bar 200 on one side of a longitudinal center-point of the elongated bar 200 and at least one of the holes 231*a*, 231*b* is formed into the outer surface of the elongated bar 200 on the opposite side of the longitudinal center-point of the elongated bar 200. In the exemplified embodiment there are two holes 230*a*, 230*b* on the first side of the elongated bar 200 and two holes 231*a*, 231*b* on the second side of the elongated bar 200, although more or less than two holes can be positioned on the opposing sides of the elongated bar 200 in other embodiments. In the exemplified embodiment, the holes 230*a*, 230*b*, 211*a*, 231*b* do not extend through the entirety of the elongated bar 200. However, in other embodiments one or more of the holes 210*a*, 230*b*, 231*a*, 231*b* may extend through the entirety of the elongated bar 200. The holes 230*a*, 230*b*, 231*a*, 231*b* are used as connectors for the resistance bands 300 as will be discussed in more detail below with reference to FIG. 5.

The first member 210 has textured regions 215 (also known in the art as knurling regions) extending from the first end 201 of the elongated bar inwardly towards a center of the first member 210 and extending from the second end 211 of the first member 210 inwardly towards a center of the first member. Furthermore, the second member 220 has a textured region 225 extending from the second end 202 of the elongated bar 200 inwardly towards a center of the second member 220. The textured regions are portions of the elongated bar 200 that has a series of protrusions that enhance the gripability of the elongated bar 200 during use. Specifically, it is common with weight lifting bars to use a knurling process to cut or roll diamond-shaped criss-cross patterns into the metal to enable a user's hands or fingers to get a better grip on the weight lifting bar than would be provided with a smooth surface. In the exemplified embodiment, each of the holes 230*a*, 230*b*, 231*a*, 231*b* is formed into one of the textured regions 215, 225 of the elongated bar 200.

Figure 4:
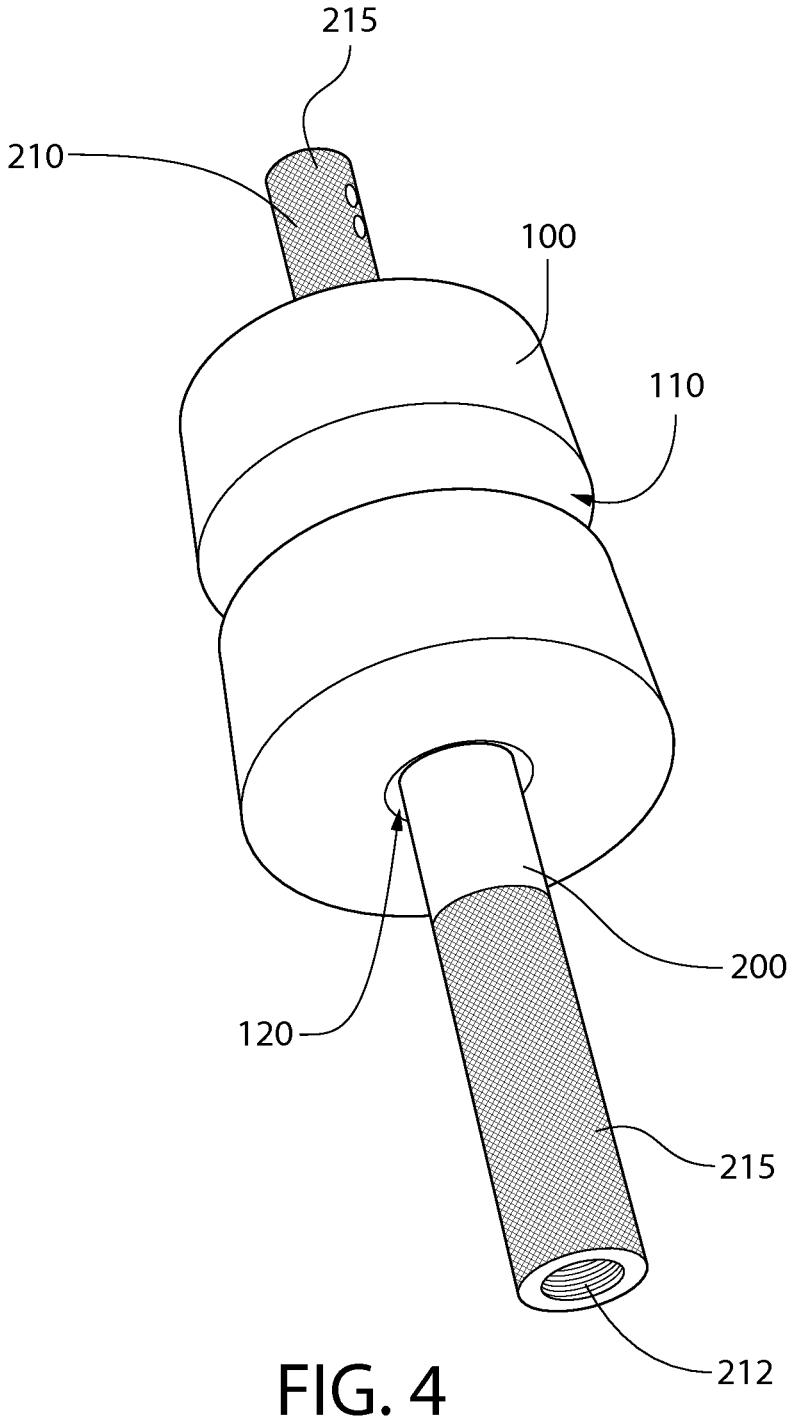
FIG. 4 is a perspective view of the elongated bar positioned within a bore of the cylindrical body.

By having both end regions of the first member 210 formed with a texture, when the first member 210 is used alone for a workout routine without being coupled to the second member 220, a user will still have two textured regions to grip onto (one for each hand). Specifically, as depicted in FIG. 4, in one use only the first member 210 is inserted through the bore 120 of the cylindrical body 100 to reduce the amount of the elongated bar 200 that would otherwise extend from the bore 120. Because the first member 210 has two textured regions 215, one for each hand, a user will be able to achieve an acceptable grip on the first member 210 of the elongated bar 200 during use. Furthermore, because the two textured regions 215 are provided on the first member 210 that has the female connector 212, there are no protrusions or other structural features that will dig into the user's hand or otherwise cause discomfort during use.

Figure 9:
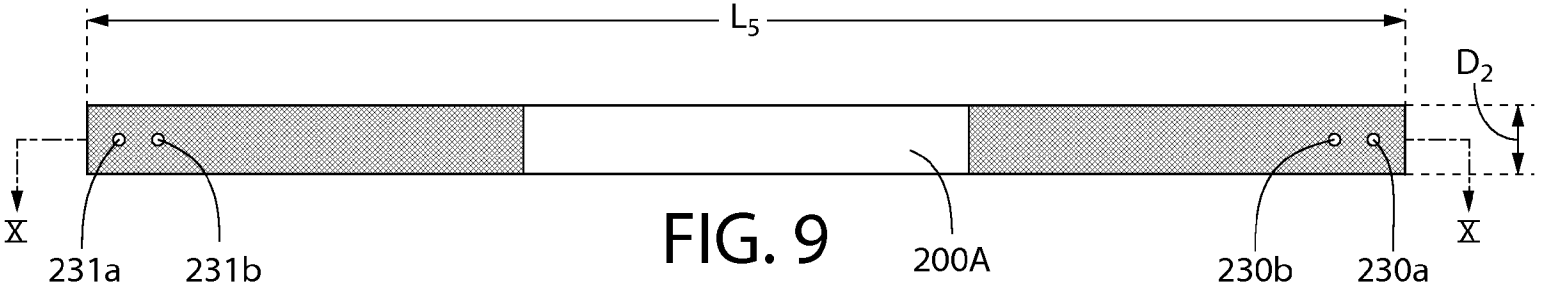
FIG. 9 is a front view of the elongated bar of FIG. 1.
Figure 10:
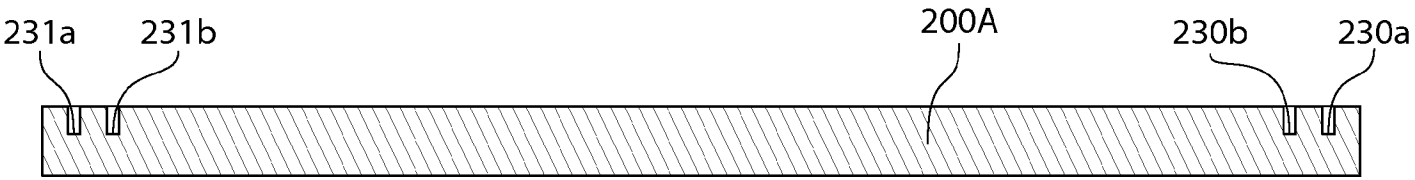
FIG. 10 is a first embodiment of a cross-sectional view taken along line X-X of FIG. 9.

Referring briefly to FIGS. 9 and 10, an alternative embodiment of an elongated bar 200A is illustrated. In this embodiment, the elongated bar 200A is a single-piece structure such that it does not include separate members that are detachably coupled together. All other features of the elongated bar 200A are the same as the features of the elongated bar 200 described with reference to FIGS. 1 and 11 and described below with regard to FIGS. 9-11, except with regard to the location of the textured regions of the bar 200A, as discussed below. In one embodiment, the cylindrical body 100, the two-piece bar 200, the one-piece bar 200A, and one or more of the resistance bands 300 may be sold and/or packaged together as a kit. In one embodiment the kit may include only one of the two-piece bar 200 and the one-piece bar 200A, although in other embodiments both of the two-piece bar 200 and the one-piece bar 200A may be included in the kit. The kit may, in some embodiments, include any of two or more of the components described herein.

Figure 11:
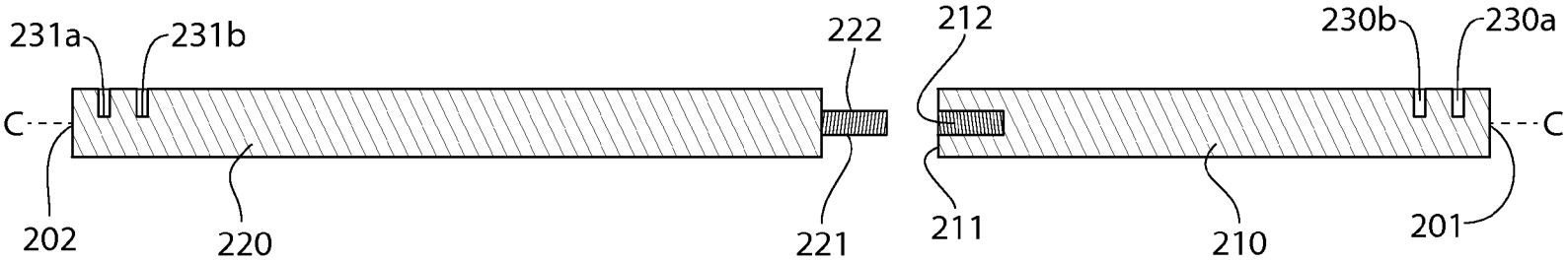
FIG. 11 is a second embodiment of a cross-sectional view taken along line X-X of FIG. 9.

Referring to FIGS. 9-11 concurrently, the elongated bar 200 will be further described. The elongated bar 200 may be formed of a metal material, such as steel, chrome, black oxide, aluminum, or any other metal commonly used in weight training or for exercise purposes. In one particular embodiment, the elongated bar 200 is formed of aluminum with a black anodize finish. Of course, the invention is not to be so limited in all embodiments and in certain other embodiments the elongated bar 200 may be formed of other materials as desired. Specifically, in one embodiment the elongated bar 200 may be funned of a composite material, such as any hard plastic including without limitation acrylonitrile butadiene styrene (ABS). When formed of a hard plastic, the elongated bar 200 can be formed in a mold which simplifies the manufacturing process and may result in a lighter weight product.

Furthermore, the elongated bar 200 may have a weight in a range of 2-6 lbs., and more specifically approximately 4.4 lbs. The elongated bar 200 may have a fifth length $L_5$ that is between 25 and 45 inches, more specifically between 30 and 40 inches, and still more specifically approximately 35 inches or approximately 36 inches. In certain embodiments, the fifth length $L_5$ is greater than the fourth length $L_4$ of the cylindrical body 100. More specifically, in certain embodiments a ratio of the fifth length $L_5$ to the fourth length $L_4$ is between 5.5:1 and 6.5:1, more specifically between 5.8:1 and 6.2:1, and still more specifically approximately 6:1. As a result, a portion of the elongated bar 200 protrudes from both of the first and second ends 101, 102 of the cylindrical body 100 when the elongated bar 200 is positioned within the bore 120 of the cylindrical body 100, as depicted in FIG. 4.

Referring again to the single-piece bar embodiment depicted in FIGS. 9 and 10, in one specific embodiment the bar 200A will have two textured or knurled regions that extend from each of the opposing ends of the bar approximately 14 inches inwardly towards the center of the bar. Because the bar 200A may be 36 inches in one embodiment, such a bar may have approximately 8 inches in the central region of the bar 200A that is smooth and free of texturing or knurling. This central region of the bar 200A may be left smooth so that when the bar 200A is inserted into the bore 120 of the cylindrical body 100, the smooth portion of the bar 200A engages the inner surface 103 of the cylindrical body 100 that defines the bore 120. Of course, the 14 inch and 8 inch dimensions are mere examples, and other lengths of the bar may be knurled/textured and smooth in other embodiments. Specifically, in one embodiment opposite ends of the bar may have anywhere from 5 inches to 15 inches that is textured/knurled, and the center region of the bar may have anywhere from 6 inches to 26 inches that is left smooth and free of texturing/knurling. It is merely important that in one embodiment a central region of the bar 200A that engages the cylindrical body 100 when the bar is inserted into the bore 120 is left smooth and free of texturing/knurling. Preferably, the portion of the central region of the bar 200A that is smooth has a length that is equal to or greater than the length of the cylindrical body 101) (or at least the length of the bore 120 of the cylindrical body 100).

Furthermore, in embodiments that utilize the two-piece bar 200, at least the first member 210 of the two piece bar 200 that has the two textured regions 215 may have a length that is greater than the fourth length $L_4$ of the cylindrical body 100. Thus, when the first member 210 of the elongated bar 200 is used alone for a workout as depicted in FIG. 4, at least a portion of (and possibly the entirety of) the textured regions 215 on each side of the first member 210 will protrude from the cylindrical body 100 for gripping by a user to achieve a desired workout routine while the smooth portion of the first member 210 engages the cylindrical body 100 within the bore 120.

Referring again to FIGS. 9-11, in the exemplified embodiment the elongated bar 200 has a second diameter $D_2$. In certain embodiments the second diameter $D_2$ is between 1.0 and 1.5 inches, more specifically between 1.15 and 1.35 inches, and still more specifically approximately 1.25 inches. Thus, the second diameter $D_2$ of the elongated bar 200 is less than the first diameter $D_1$ of the bore 120, which enables the elongated bar 200 to be inserted into the bore 120 as discussed in more detail below with reference to FIG. 4. Furthermore, the second diameter $D_2$ is less than the third length $L_3$ of the groove portion 106 of the cylindrical body 100, which enables the elongated bar 200 to be positioned within the annular groove 110 when desired. In certain embodiments, the ratio of the third length $L_3$ to the second diameter $D_2$ is between 1.25:1 and 1.5:1, more specifically between 1.3:1 and 1.4:1, and still more specifically approximately 1.36:1.

In the exemplified embodiment, the difference between the third length $L_3$ of the groove portion 106 (which may also be considered the width of the annular groove 110) and the second diameter $D_2$ of the elongated bar 200 is kept to a minimum to ensure that there is minimal "play" or movement between the elongated bar 200 and the cylindrical body 100 in the longitudinal direction of the cylindrical body 100 when the elongated, bar 200 is positioned within the annular groove 110. In that regard, in certain embodiments the difference between the third length $L_3$ of the groove portion 106 and the second diameter $D_2$ of the elongated bar 200 is between 0.3 and 0.6 inches, more specifically between 0.4 and 0.5 inches, and still more specifically approximately 0.45 inches. Thus, referring briefly to FIG. 3, when the elongated bar 200 is positioned within the annular groove 110, in certain embodiments there may be a gap $G_1$ of between 0.1 and 0.4 inches, more specifically between 0.2 and 0.3 inches, and still more specifically approximately 0.225 inches between each of the first and second ends 113, 114 of the annular groove 110 and the outer surface of the elongated bar 200.

Thus, in one exemplary embodiment (see FIG. 3), the elongated bar 200 can nest within the annular groove 110 so that the outer surface of the elongated bar 200 is in contact with the floor 111 of the groove 110 and is positioned inwardly of (i.e., spaced apart from/not in contact with) the first and second ends 113, 114 of the annular groove 110. However, in other embodiments the third length $L_3$ of the annular groove 110 may be reduced slightly so that when the elongated bar 200 nests within the annular groove 110, the outer surface of the elongated bar 200 rests atop of the first and second ends 113, 114 of the annular groove 110, and the outer surface of the elongated bar 200 is spaced from the floor 111 of the annular groove 110. In such embodiment, the elongated bar 200 may be in rolling contact with the first and second ends 113, 114 of the annular groove 110 rather than with the floor 111 of the annular groove 110. In other embodiments the elongated bar 200 may be in rolling contact with the first and second ends 113, 114 of the elongated groove 110 and with the floor 111 of the annular groove 110.

Referring back to FIG. 1, the resistance bands 300 will be further described. In the exemplified embodiment there are four resistance bands 300 illustrated that form a part of the system 1000 or kit. However, more or less than four resistance bands 300 can form a part of the system 1000 or kit in other embodiments. The resistance bands 300 can be any type of resistance cords that are commonly used during exercise routines such that the resistance bands 300 stretch when a force is applied to them and retract/bias back to their original size and shape after the force is no longer being applied to them. The resistance bands 300 can be bungee cords or shock cords in certain embodiments that are formed from one or more elastic strands that form a core and are covered in a woven cotton or polypropylene sheath. Alternatively, the resistance bands 300 can be bands formed of an elastic material, like a thick and oversized rubber band. Furthermore, the resistance bands 300 can be any type of latex product that has an inner diameter and an outer diameter, such as a tube-shaped latex product that has a hollow interior extending along its length. Thus, any band or cord that can stretch from its original length when a force is applied thereto while providing resistance and which will bias back to its original length when the force is no longer being applied thereto may be used as the one or more resistance bands 300. The resistance bands 300 can each have different levels of resistance, or they may all have the same resistance as desired. Each of the resistance bands 300 has a hook 301 on both of its opposing ends to facilitate attachment of the resistance bands 300 to the elongated bar 200.

In one embodiment, a central portion of the resistance bands 300 located centrally between the opposing ends of the resistance bands 300 (and centrally between the hooks 301 on the opposing ends of the resistance bands 300) will be marked with a marker 302 that has a color that contrasts with the color of the remainder of the resistance band 300. Thus, if the resistance band 300 is red, the marker 302 can be any color other than red (such as black, white, green, blue, etc). Although depicted herein as being square in shape, the marker 302 can take on any polygonal shape, or can be in the form of a ring that circumscribes the resistance band 300 at a particular axial location on the resistance band 300. This marker 302 marks the spot where a user can stand on the resistance bands 300 during, use to anchor the resistance bands 300 to the floor to achieve a workout while obtaining the most resistance from the resistance band 300. In FIG. 1, the bottom one of the resistance bands 300 has a single marker 302 that is centrally located between the ends of the resistance band 300. A single marker 302 may provide a position that a user should anchor the resistance band 300 with a single foot when such single anchoring is desired for certain exercises. In FIG. 1, the second to the bottom one of the resistance bands 300 has two markers that are equidistantly spaced from the center of the resistance band 300. Two markers 302 may be provided on a single resistance band 300 to provide positions that a user should anchor the resistance band 300 with both feet such dual anchoring is desired for certain exercises.

Figure 12:
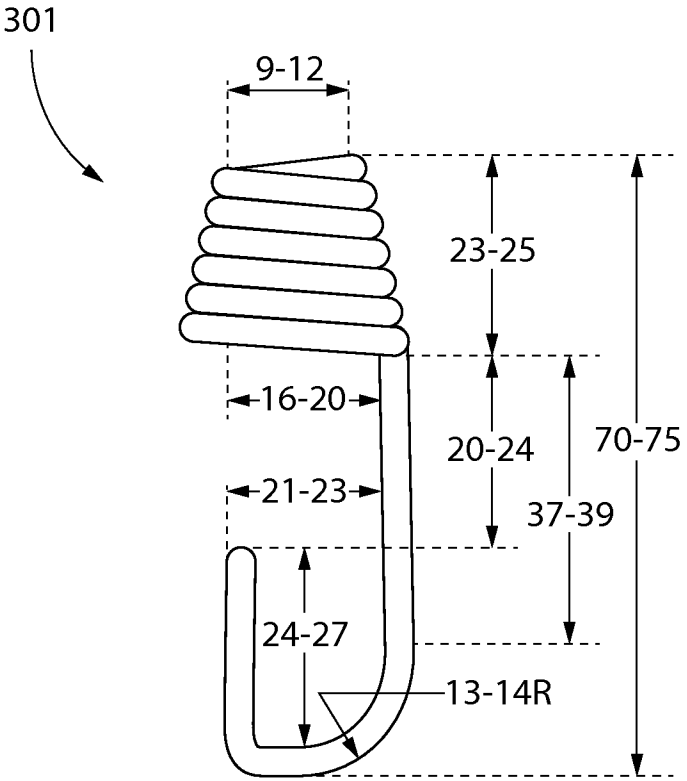
FIG. 12 is a front view of a hook portion of the resistance bands in accordance with an embodiment of the present invention.

One exemplified embodiment of the hook 301 is illustrated in FIG. 12. In FIG. 12, several of the dimensions are provided for the various portions of the hook 301. The dimensions are provided in millimeters. Of course, variations in the size, shape, and various dimensions of the hook 301 are possible in certain embodiments. It is merely desired that the hook 301 be capable of being inserted into the holes 230*a*, 230*b*, 231*a*, 231*b* of the elongated bar 200 to removably couple the resistance bands 300 to the elongated bar 200, as discussed below with reference to FIG. 5.

Figure 3:
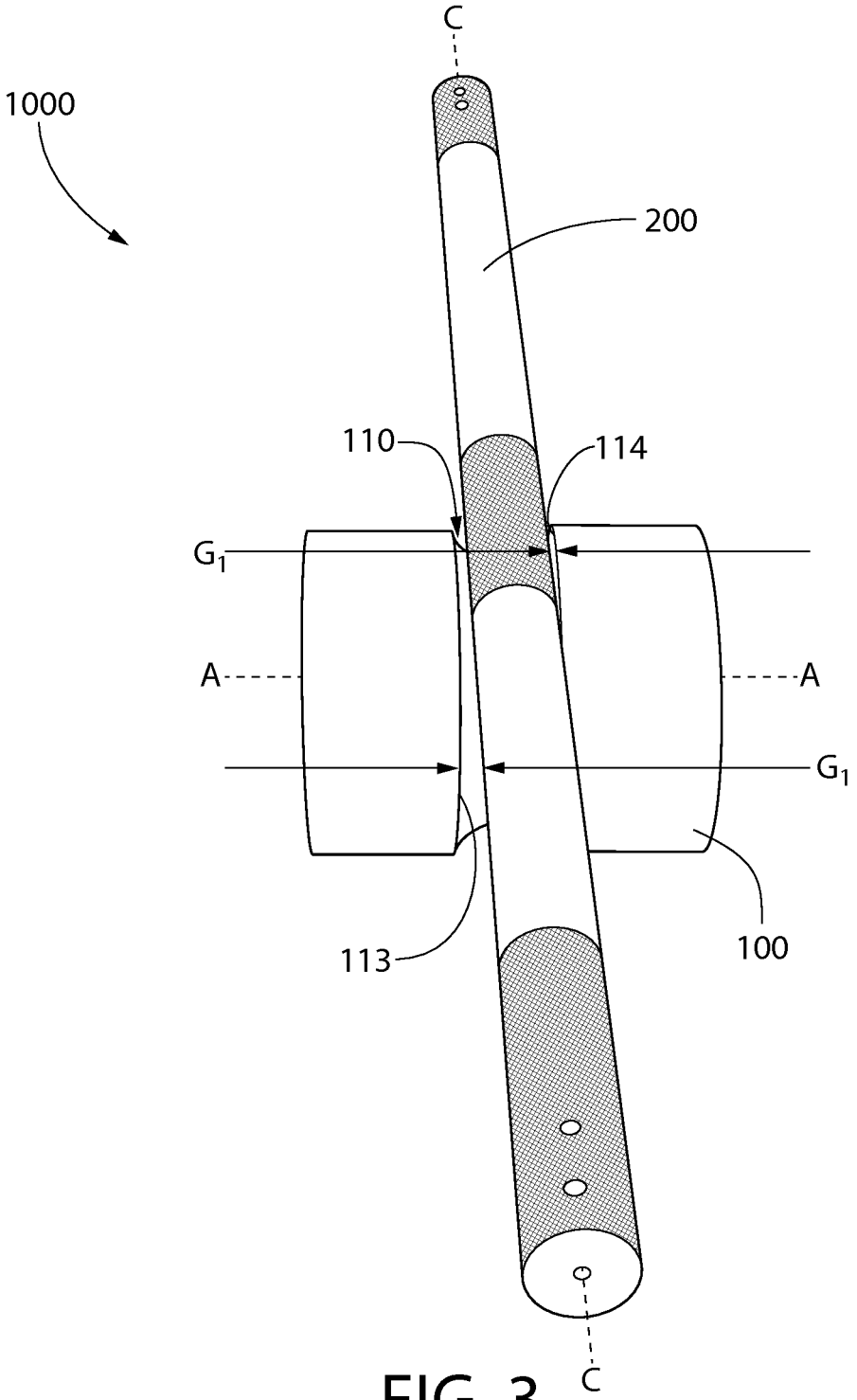
FIG. 3 is a perspective view of the elongated bar positioned within an annular groove of the cylindrical body.

Referring to FIG. 3, the system 1000 is illustrated with the elongated bar 200 positioned within the annular groove 110 of the cylindrical body 100. In this embodiment, the elongated bar 200 fits within the annular groove 110 because the length $L_3$ of the groove portion 106 of the cylindrical body 106 measured between the first end 113 of the annular groove 110 and the second end 114 of the annular groove 110 is greater than the second diameter $D_2$ of the elongated bar 200. Furthermore, the ratio of the third length $L_3$ of the groove portion 106 to the second diameter $D_2$ of the elongated bar 200 is, as discussed above, between 1.25:1 and 1.5:1, more specifically between 1.3:1 and 1.4:1, and still more specifically approximately 1.36:1, which provides a limited amount of "play" between the outer surface of the elongated bar 200 and the first and second ends 113 of the annular groove 110. Thus, when the elongated bar 200 is positioned within the annular groove 110, minimal (if any) movement of the elongated bar 200 in the direction of the longitudinal axis A-A of the cylindrical body 100 is permitted. Rather, the elongated bar 200 nests within the annular groove 110 and remains so positioned due to the combination of the depth $d_1$ of the annular groove 110, the diameter $D_2$ of the elongated bar 200, and the length $L_3$ of the annular groove 110.

When the elongated bar 200 is nested within the annular groove 110, the annular bar 200 is able to readily slide or roll within the annular groove 110 for relative to the annular groove 110) in a direction transverse to the longitudinal axis A-A of the cylindrical body 100 and along the direction of the longitudinal axis C-C of the elongated bar 200. Specifically, with the elongated bar 200 in the annular groove 110, a user will grip opposite ends of the elongated bar 200 while the user is in a push-up (or modified push-up) position, putting all (or some) of his or her weight on the elongated bar 200. The user will be able to move the elongated bar 200 from left to right and from right to left (in both opposing directions of the longitudinal axis of the elongated bar 200), which will, cause the cylindrical body 100 to roll along the floor or other horizontal surface upon which it is resting in the same direction of movement of the elongated bar 200. Specifically, the cylindrical body 100 will roll along the floor and the elongated bar 200 will remain nested within the annular groove 110 during this exercise routine. Thus, as the cylindrical body 100 rolls along the floor, the portion of the elongated bar 200 (the longitudinal location of the elongated bar 200) that is positioned within the annular groove 110 will change.

Furthermore, while the elongated bar 200 is positions within the annular groove 110, the elongated bar 200 is also able to pivot about an axis that is perpendicular to the longitudinal axis C-C and that intersects the portion of the elongated bar 200 that is in surface contact with the floor III of the annular groove 110 to work different, muscles of the user's body. Thus, the elongated bar 200 can be pivoted so that one end of the elongated bar 200 is tilted upwards while the other end of the elongated bar is tilted downwards. This can enable the user to strengthen or exercise different parts of a muscle depending on the tilt angle of the elongated bar 200 (for example, different parts of the pectoralis muscle can be exercised depending, on the tilt angle/degree/direction of the elongated bar 200).

Figure 5:
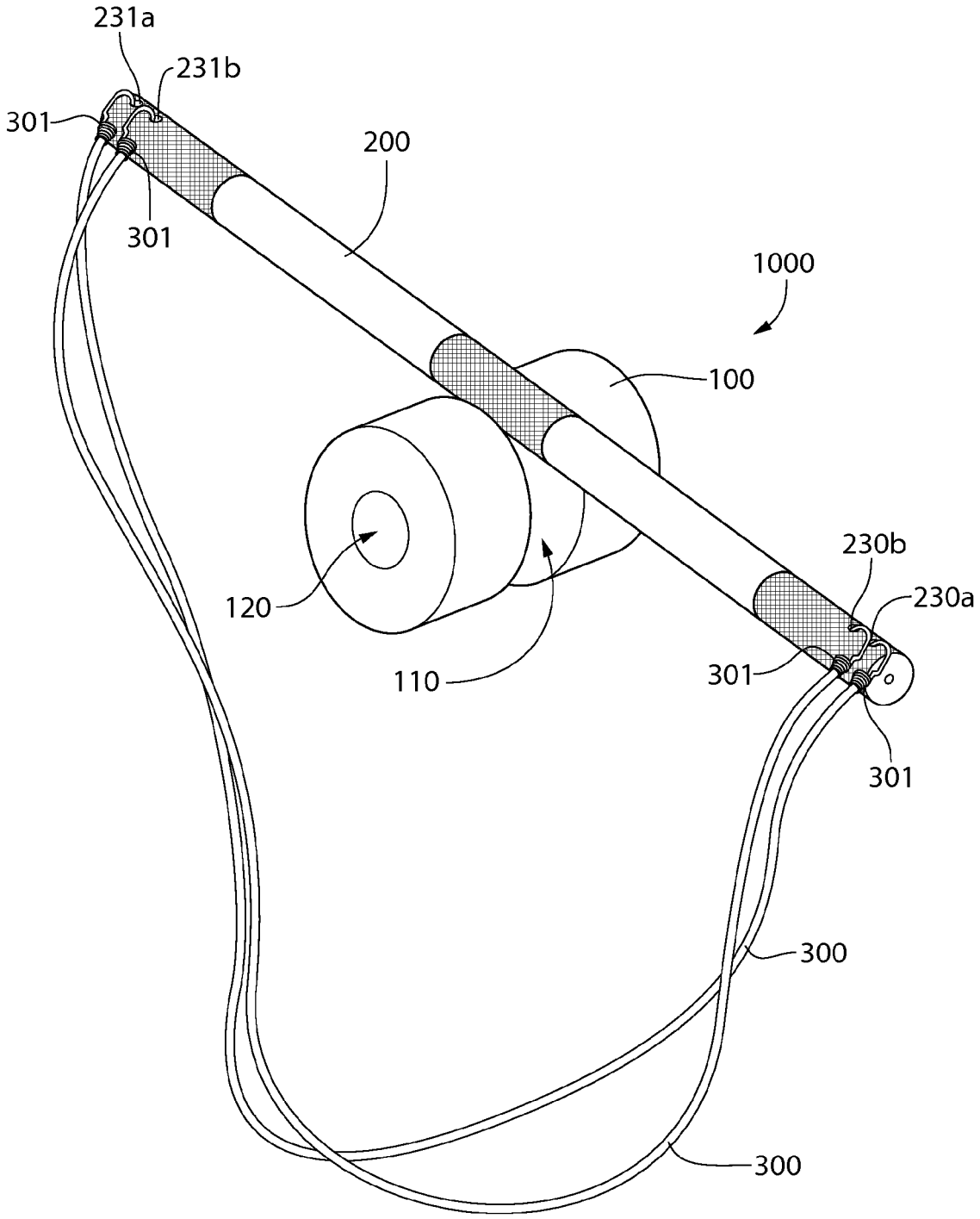
FIG. 5 is a perspective view of the elongated bar positioned within an annular groove of the cylindrical body and two of the resistance bands coupled to the elongated bar.

Referring briefly to FIG. 5, the system is illustrated with the elongated bar 200 positioned within the annular groove 110 of the cylindrical body 100 and with two of the resistance bands 300 detachably coupled to the elongated bar 200. Specifically, to attach the resistance bands 300 to the elongated bar 200, the hooks 301 of the resistance bands 300 are slid into the openings 230*a*, 230*b*, 231*a*, 231*b* of the elongated bar 200. Specifically, the hooks 301 of a first one of the resistance bands 300 are inserted into one of the holes 230*a*, 230*b* and one of the holes 231*a*, 231*b* and the hooks 301 of a second one of the resistance bands 300 are inserted into the other one of the holes 230*a*, 230*b* and the other one of the holes 231*a*, 231*b*. In certain embodiments, only one of the resistance bands 300 may be coupled to the elongated bar 200, and in other embodiments more than two resistance bands may be coupled to the elongated bar 200 when additional holes are provided.

When the resistance bands 300 are coupled to the elongated bar 200, a central portion of the resistance hands 300 that is located in between the two ends with the hooks 301 may be positioned within the annular groove 110 so as to be trapped between the cylindrical body 100 and the floor. In this position, the user can work out his or her biceps by curling the elongated bar, triceps by doing overhead extensions, deltoids by doing shoulder presses, trapezius by doing shrugs, quadriceps by doing squats, or the like. The user may rest one of his or her feet on the cylindrical body 100 when doing these exercises to ensure that the cylindrical body 100 remains in surface contact with the floor with the resistance bands 300 trapped between the cylindrical body 100 and the floor. This will ensure that the resistance bands 300 stretch during these exercises rather than lifting the cylindrical body 100 off of the floor. Alternatively, the user may use the resistance bands and the elongated bar 200 separate from the cylindrical body 100 by the user standing on the central portion of the resistance bands 300 and doing the above-noted exercises.

Referring to FIG. 4, the system is illustrated, with the elongated bar 200 positioned within and through the bore 120 of the cylindrical body 100. Because the first diameter $D_1$ of the bore 120 is larger than the second diameter $D_2$ of the elongated bar 200, the elongated bar 200 is able to be inserted into and through the bore 120. In this figure, only one of the members of the two-piece bar is illustrated positioned within the bore 120. However, the members can be coupled together and then inserted into the bore 120, or a single-piece elongated bar can be used. When the elongated bar 200 is positioned within the bore 120, a user can exercise by getting on his or her knees and grabbing hold of the opposite ends of the elongated bar 200. The user can then slide/roll the elongated bar 200 and the cylindrical body 100 in a direction away from and towards the user to achieve an abdominal/core/full body workout. Variations of this particular workout can be achieved as would be understood by persons of skill in the art, such as by the user being positioned on his or her toes and then sliding/rolling the elongated bar 200 and the cylindrical body 100 in a direction away from and towards the user. Furthermore, in some embodiments the resistance bands 300 can be coupled to the elongated bar 200 when the elongated bar 200 is positioned within the bore 120 of the cylindrical body 100 and exercise routines can be conducted with the system 1000 in that position.

As can be seen in FIG. 4 and as discussed above, in one embodiment it may be desirable to use the first member 210 of the two-piece elongated bar 200 for this exercise because the first member 210 has the two textured regions 215, is longer than the bore 120, and is not as long as the elongated bar 200 in its entirety so it takes up less space during a workout routine. Furthermore, the first member 210 has the female threaded connector 212, so there are no protruding structures that can damage the user's hand or cause discomfort during use.

Figure 13:
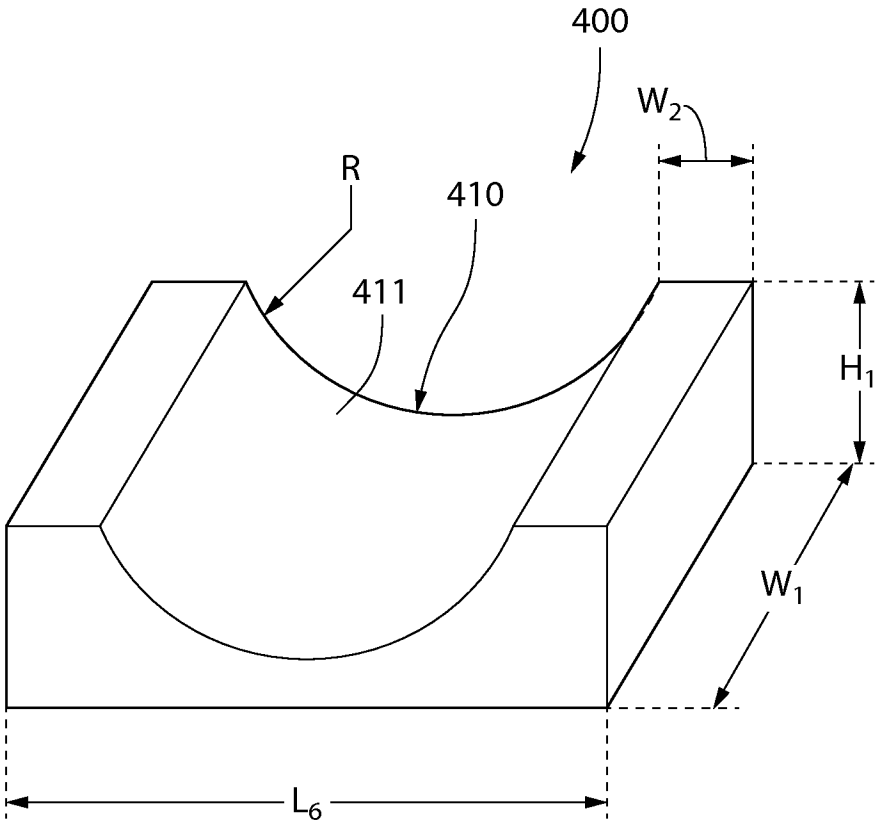
FIG. 13 is a perspective view of a cradle in accordance with an embodiment of the present invention.

Finally, referring to FIG. 13, a cradle 400 is illustrated. The cradle 400 may be used for storage of the cylindrical body 100, or it may be used as a sort of training, wheels that prevents the cylindrical body 100 from rotating, along the floor during use. Thus, the above exercises can be conducted while the cylindrical body 100 is nested in the cradle 400 to prevent rolling movement of the cylindrical body 100 during the workout routine. In certain embodiments the cradle 400 may be sold together with the cylindrical base 100, the elongated bar 200, and the one or more resistance bands 300 in the kit. In other embodiments, the cradle 400 may be sold separately from the other components on an as-needed basis. The cradle 400 may be formed of any desired material, including metals, metal alloys, plastics, rubbers, or the like.

Various dimensions of the cradle 400 will be described below. However, it should be appreciated that the dimensions of the cradle 400 can be modified depending on the dimensions of the cylindrical body 100 which is used with the cradle 400. The cradle 400 has a sixth length that is between 6.6 and 7.0 inches, and more specifically approximately 6.8 inches. The cradle 400 has a first width $W_1$ that is between 5.6 and 6.4 inches, and more specifically approximately 6.0 inches. The cradle 400 has a height $H_1$ that is between 2.0 and 2.6 inches, and more specifically 2.3 inches. The cradle 400 has a second width $W_2$ which is between 0.8 and 1.2 inches, and more specifically approximately 1.0 inches. Furthermore, the shape of the cradle 400 defines a cavity 410 within which the cylindrical body 100 may be positioned as desired. The cavity 411 has a floor with a radius of curvature R. The radius of curvature R may be between 2.5 and 2.8 inches, more specifically between 2.6 and 2.7 inches, and still more specifically approximately 2.62 inches.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be consulted broadly as set forth in the appended claims.

What is claimed is:

1. An exercise system comprising:

a cylindrical body extending from a first end to a second end along a longitudinal axis, the cylindrical body having an outer surface;

an annular groove formed into the outer surface of the cylindrical body, the annular groove located between the first and second ends of the cylindrical body, a rubber overmold at least partially covering a floor of the annular groove;

the cylindrical body having a first cylindrical portion extending between the first end of the cylindrical body and a first end of the annular groove and having a first length, a second cylindrical portion extending between the second end of the cylindrical body and a second end of the annular groove and having a second length, and a groove portion extending between the first and second ends of the annular groove and having a third length, the third length being less than each of the first and second lengths;

a bore formed into the cylindrical body and extending from a first opening at the first end of the cylindrical body to a second opening at the second end of the cylindrical body, the bore having a first diameter; and an elongated bar extending from a first end to a second end, the elongated bar having a second diameter that is less than the first diameter, the elongated bar being removably insertable into and through the bore of the cylindrical body.

2. The exercise system of claim 1 wherein the annular groove has a minimum radius of curvature that is greater than a radius of the elongated bar, the elongated bar being positionable within the annular groove in between the first and second ends of the annular groove and in rolling contact with the floor of the annular groove.

3. An exercise system comprising:

a cylindrical body extending from a first end to a second end along a longitudinal axis, the cylindrical body having an outer surface;

an annular groove formed into the outer surface of the cylindrical body, the annular groove located between the first and second ends of the cylindrical body;

the cylindrical body having a first cylindrical portion extending between the first end of the cylindrical body and a first end of the annular groove and having a first length, a second cylindrical portion extending between the second end of the cylindrical body and a second end of the annular groove and having a second length, and a groove portion extending between the first and second ends of the annular groove and having a third length, the third length being less than each of the first and second lengths;

a bore formed into the cylindrical body and extending from a first opening at the first end of the cylindrical body to a second opening at the second end of the cylindrical body, the bore having a first diameter; and an elongated bar extending from a first end to a second end, the elongated bar having a second diameter that is less than the first diameter, the elongated bar being removably insertable into and through the bore of the cylindrical body;

wherein the cylindrical body comprises:

a tube portion having a length, the tube portion having an inner surface that defines the bore; and an overmold portion that is molded to the tube portion along an entirety of the length of the tube portion, the overmold portion having a first end that forms at least a portion of the first end of the cylindrical body and a second end that forms at least a portion of the second end of the cylindrical body, the first and second ends of the cylindrical body each being flat, planar surfaces; and wherein no portion of the tube portion protrudes from the first and second ends of the overmold portion.

4. The exercise system of claim 3 wherein the tube portion is formed of a material having a first hardness value and wherein the overmold portion is formed of a material having a second hardness value, the first hardness value being greater than the second hardness value.

5. The exercise system of claim 4 wherein the tube portion is formed of carbon steel and the overmold portion is formed of a styrene-butadiene rubber having a hardness value between 70 and 80 Shore A.

6. An exercise system comprising:

a cylindrical body extending from a first end to a second end along a longitudinal axis, the cylindrical body having an outer surface;

an annular groove formed into the outer surface of the cylindrical body, the annular groove located between the first and second ends of the cylindrical body;

the cylindrical body having a first cylindrical portion extending between the first end of the cylindrical body and a first end of the annular groove and having a first length, a second cylindrical portion extending between the second end of the cylindrical body and a second end of the annular groove and having a second length, and a groove portion extending between the first and second ends of the annular groove and having a third length, the third length being less than each of the first and second lengths, wherein the first length and the second length are substantially the same, and wherein a ratio of each of the first and second lengths to the third length is between 1.15:1 and 1.65:1;

a bore formed into the cylindrical body and extending from a first opening at the first end of the cylindrical body to a second opening at the second end of the cylindrical body, the bore having a first diameter; and an elongated bar extending from a first end to a second end, the elongated bar having a second diameter that is less than the first diameter, the elongated bar being removably insertable into and through the bore of the cylindrical body.

7. The exercise system of claim 6 wherein the ratio of each of the first and second lengths to the third length is approximately 1.25:1.

8. The exercise system of claim 1 wherein the cylindrical body has a third diameter measured at the outer surface of the cylindrical body, and wherein a ratio of the third diameter to the first diameter is between 3.1:1 and 3.9:1.

9. The exercise system of claim 8 wherein the annular groove has a depth measured from a lowermost point on the floor of the annular groove to an outermost portion of the outer surface of the cylindrical body located at the first and second cylindrical portions of the cylindrical body, and wherein a ratio of the third diameter of the cylindrical body to the depth of the annular groove is between 7.5:1 and 9.0:1.

10. The exercise system of claim 9 wherein a ratio of the first diameter of the bore to the depth of the annular groove is between 2.25:1 and 2.5:1.

11. The exercise system of claim 1 wherein the annular groove is located centrally in between the first and second ends of the cylindrical body so that a center-point of the annular groove positioned between the first and second ends of the annular groove is equidistant from the first end of the cylindrical body and the second end of the cylindrical body.

12. The exercise system of claim 1 wherein the elongated bar comprises:

a first member extending from the first end of the elongated bar to a second end, the second end of the first member comprising a first connector; and a second member extending from a first end to the second end of the elongated bar, the first end of the second member comprising a second connector; and wherein the first and second members of the elongated bar are detachably coupled together by connecting the first connector to the second connector; and wherein one of the first and second connectors is a male thread and the other one of the first and second connectors is a female thread.

13. The exercise system of claim 1 further comprising:

the elongated bar having an outer surface, at least a first hole formed into the outer surface of the elongated bar adjacent the first end of the elongated bar and at least a second hole formed into the outer surface of the elongated bar adjacent the second end of the elongated bar; and a resistance band extending from a first end to a second end, a first hook coupled to the first end of the resistance band and a second hook coupled to the second end of the resistance band, and wherein the first hook is detachably couplable to the elongated bar by inserting the first hook into the first hole and wherein the second hook is detachably couplable to the elongated bar by inserting the second hook into the second hole.

14. The exercise system of claim 1 wherein the cylindrical body has a fourth length measured from the first end of the cylindrical body to the second end of the cylindrical body, the fourth length being equal to the first length plus the second length plus the third length, wherein the elongated bar has a fifth length measured from the first end of the elongated bar to the second end of the elongated bar, and wherein the fifth length is greater than the fourth length so that a portion of the elongated bar protrudes from both of the first and second ends of the cylindrical body when the elongated bar is positioned within the bore of the cylindrical body.

15. The exercise system of claim 14 wherein a ratio of the fifth length to the fourth length is between 5.5:1 and 6.5:1.

16. The exercise system of claim 1 wherein the first and second cylindrical portions of the cylindrical body and the groove portion of the cylindrical body are formed as a single unitary structure.

17. The exercise system of claim 1 further comprising:

the annular groove having a minimum radius of curvature that is greater than a radius of the elongated bar, the elongated bar being positionable within the annular groove in between the first and second ends of the annular groove and in rolling contact with the floor of the annular groove;

the first length and the second length being substantially the same, and a ratio of each of the first and second lengths to the third length is between 1.2:1 and 1.3:1;

the third length being between 0.4 and 0.5 inches greater than the second diameter of the elongated bar;

the cylindrical body having a third diameter measured at the outer surface of the cylindrical body, and wherein a ratio of the third diameter to the first diameter is between 3.4:1 and 3.6:1;

the annular groove having a depth measured from a lowermost point on the floor of the annular groove to the outer surface of the cylindrical body, and wherein a ratio of the third diameter of the cylindrical body to the depth of the annular groove is between 8.1:1 and 8.5:1;

a ratio of the first diameter of the bore to the depth of the annular groove is between 2.25:1 and 2.5:1; and wherein the first and second cylindrical portions of the cylindrical body and the groove portion of the cylindrical body are formed as a single unitary structure.

18. An exercise kit comprising:

a cylindrical body extending from a first end to a second end along a longitudinal axis, the cylindrical body comprising:

an annular groove formed into the outer surface of the cylindrical body, the annular groove located between the first and second ends of the cylindrical body and having a minimum radius of curvature; and a bore formed into the cylindrical body and extending from the first end of the cylindrical body to the second end of the cylindrical body, the bore having a first diameter;

a bar extending along a longitudinal axis and having an outer surface with a second diameter that is less than the first diameter so that the bar can be inserted into and through the bore, the second diameter of the bar being less than two times the minimum radius of curvature of the annular groove so that the bar can be positioned within the annular groove so as to be in rolling contact with a floor of the annular groove, the bar having a first hole and a second hole formed into the outer surface of the bar on opposite sides of a longitudinal center-point of the bar; and a resistance band having a first hook coupled to a first end of the resistance band and a second hook coupled to a second end of the resistance band, and wherein the first hook is detachably couplable to the elongated bar by inserting the first hook into the first hole and wherein the second hook is detachably couplable to the elongated bar by inserting the second hook into the second hole.

19. The exercise kit of claim 18 wherein the cylindrical body further comprises:

a first cylindrical portion extending between the first end of the cylindrical body and a first end of the annular groove, the first cylindrical portion of the cylindrical body having a first length;

a second cylindrical portion extending between the second end of the cylindrical body and a second end of the annular groove, the second cylindrical portion of the cylindrical body having a second length; and a groove portion extending between the first and second ends of the annular groove, the groove portion of the cylindrical body having a third length; and wherein the first and second lengths are substantially the same, and wherein the third length is less than each of the first and second lengths.

* * * * *